US008005401B2

(12) United States Patent
Furukawa et al.

(10) Patent No.: US 8,005,401 B2
(45) Date of Patent: Aug. 23, 2011

(54) IMAGE FORMING APPARATUS INCLUDING CHARGE REMOVAL MEMBER

(75) Inventors: Toshio Furukawa, Nagoya (JP); Katsuyuki Yokoi, Iwakura (JP); Kensuke Miyahara, Hekinan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 371 days.

(21) Appl. No.: 12/342,528

(22) Filed: Dec. 23, 2008

(65) Prior Publication Data

US 2009/0162099 A1 Jun. 25, 2009

(30) Foreign Application Priority Data

Dec. 25, 2007 (JP) ..... 2007-331810

(51) Int. Cl.
*G03G 15/02* (2006.01)
*G03G 21/00* (2006.01)

(52) U.S. Cl. ..... 399/169; 399/128; 399/173

(58) Field of Classification Search ..... 399/50, 399/66, 71, 101, 128, 169, 40, 173, 302, 399/303, 312, 313

See application file for complete search history.

(56) References Cited

U.S. PATENT DOCUMENTS 4,984,024 A 1/1991 Ohkaji et al.
2003/0190171 A1* 10/2003 Yuge ..... 399/100
2004/0042820 A1 3/2004 Uchida et al.
2007/0146739 A1 6/2007 Igarashi
2008/0267657 A1* 10/2008 Mori ..... 399/101

FOREIGN PATENT DOCUMENTS

| | | |
|---|---|---|
| JP | 60-179760 | 9/1985 |
| JP | 02-256083 | 10/1990 |
| JP | 06-337596 | 12/1994 |
| JP | 07-084436 | 3/1995 |
| JP | 11-084903 | 3/1999 |
| JP | 2004-004336 | 1/2004 |
| JP | 2004-163534 | 6/2004 |
| JP | 2004-279994 | 10/2004 |
| JP | 2006-189495 | 7/2006 |
| JP | 2007-178608 | 7/2007 |

OTHER PUBLICATIONS

Office Action received for corresponding Japanese Application No. 2007-331810, mailed Aug. 4, 2009.

* cited by examiner

*Primary Examiner* — David Gray
*Assistant Examiner* — Joseph Wong
(74) *Attorney, Agent, or Firm* — Banner & Witcoff, Ltd.

(57) ABSTRACT

An image forming apparatus may be provided with a belt configured to move in the predetermined direction and face a photoreceptor, a charge removal member, and a conductive member. The charge removal member may be configured to remove charge of the belt. The conductive member may be located at the downstream side of the charge removal member in the predetermined direction. The conductive member may include a surface facing the belt.

11 Claims, 8 Drawing Sheets

IMAGE FORMING APPARATUS INCLUDING CHARGE REMOVAL MEMBER

CROSS-REFERENCE TO RELATED APPLICATION

This application claims priority to Japanese Patent Application No. 2007-331810, filed on Dec. 25, 2007, the contents of which are hereby incorporated by reference into the present application.

BACKGROUND OF THE INVENTION

1. Field of the Invention

The present invention relates to an image forming apparatus which forms an image on a medium by utilizing a photoreceptor.

2. Description of the Related Art

For example, a color laser printer forms an image on a medium (e.g. a printing paper) by utilizing a plurality of photoreceptors. Each of the photoreceptors is capable of retaining an electrostatic latent image. When developer is supplied to each of the photoreceptors, the developer is stuck to an area on which the electrostatic latent image of each photoreceptor is formed, and whereby the electrostatic latent image of each photoreceptor is visualized. Many color laser printers have a belt facing each of the photoreceptors. One embodiment of such belts is referred to as "conveyance belt." The conveyance belt conveys the medium through an area which faces each photoreceptor. Developer retained by each photoreceptor is transferred onto the medium which is being conveyed by the conveyance belt. Thus, an image is formed on the medium. Another embodiment of the belts is referred to as "intermediate transfer belt." Developer retained by each photoreceptor is transferred onto the intermediate transfer belt. The developer transferred onto the intermediate transfer belt is further transferred onto the medium. Thus, an image is formed on the medium.

Japanese Patent Application Publication No. 2004-279994 discloses a laser printer which has a conveyance belt. This laser printer has a charge removal needle which is located between two photoreceptors being adjacent in a direction of transferring a medium. The conveyance belt is electrostaticly charged by the photoreceptors located on the upstream side. The charge removal needle removes electric charges from the conveyance belt by the time the conveyance belt reaches the photoreceptors located on the downstream side.

BRIEF SUMMARY OF THE INVENTION

A charge removal member (charge removal needle in the above document) indeed enables removal of charge from a belt. However, the inventors of the present invention have found that relatively large unevenness of charge remains within the belt. The unevenness of charge of the belt affects the extent in quality of print (i.e. toner transfer onto the medium or the belt) of the photoreceptors on the downstream side. More specifically, existence of both a high electric potential portion and a low electric potential portion within the belt causes difference in the developer transfer quality among these portions. As a result, unevenness of the image density is caused on the medium. This specification discloses a technology that allows improved stabilization of the charge of the belt, compared to conventional technologies.

The inventors of the present invention have found, after a series of trial and error, that utilization of a conductive member having a surface which faces the belt enables the reduction of unevenness of charge of the belt. Further, the inventors have found that positioning of the conductive member is important and that, by locating the charge removal member at the upstream side and the conductive member at the downstream side in a movement direction of the belt, unevenness of charge at the belt is efficiently reduced. The image forming apparatus disclosed in this specification is provided based on such findings and comprises the following configurations.

One embodiment of the image forming apparatus disclosed in this specification may be provided with a plurality of photoreceptors, a belt, a charge removal member, and a conductive member. The plurality of photoreceptors may be aligned in a predetermined direction. The belt may be configured to move in the predetermined direction as described above and further may face the plurality of photoreceptors. The charge removal member may be located between two photoreceptors which are adjacent to each other in the predetermined direction. The charge removal member may be configured to remove charge of the belt. The conductive member may be located between the two photoreceptors which are adjacent in the predetermined direction. The conductive member may be located at a downstream side of the charge removal member in the predetermined direction. The conductive member may be provided with a surface which faces the belt. According to this image forming apparatus, after passing by the photoreceptor at the upstream side, charge (electric potential) of the belt can be efficiently stabilized by the time the belt reaches the photoreceptor at the downstream side.

One embodiment of image forming apparatus disclosed in this specification may comprise a photoreceptor, a belt, a cleaning member, a charge removal member, and a conductive member. The belt may be configured to move in a predetermined direction and to face the photoreceptor. The cleaning member may be configured to clean up the belt by utilizing an electric field. The charge removal member may be located at a downstream side of the cleaning member in the predetermined direction. The charge removal member may be located at an upstream side of the photoreceptor in the predetermined direction. The charge removal member may be configured to remove charge of the belt. The conductive member may be located at the downstream side of the charge removal member in the predetermined direction. Further, the conductive member may be located at the upstream side of the photoreceptor in the predetermined direction. The conductive member may be provided with a surface which faces the belt. According to the image forming apparatus, charge of the belt can be efficiently stabilized by the time when the belt reaches the photoreceptor from the cleaning member.

DETAILED DESCRIPTION OF THE PREFERRED EMBODIMENT

First Embodiment

Figure 1:
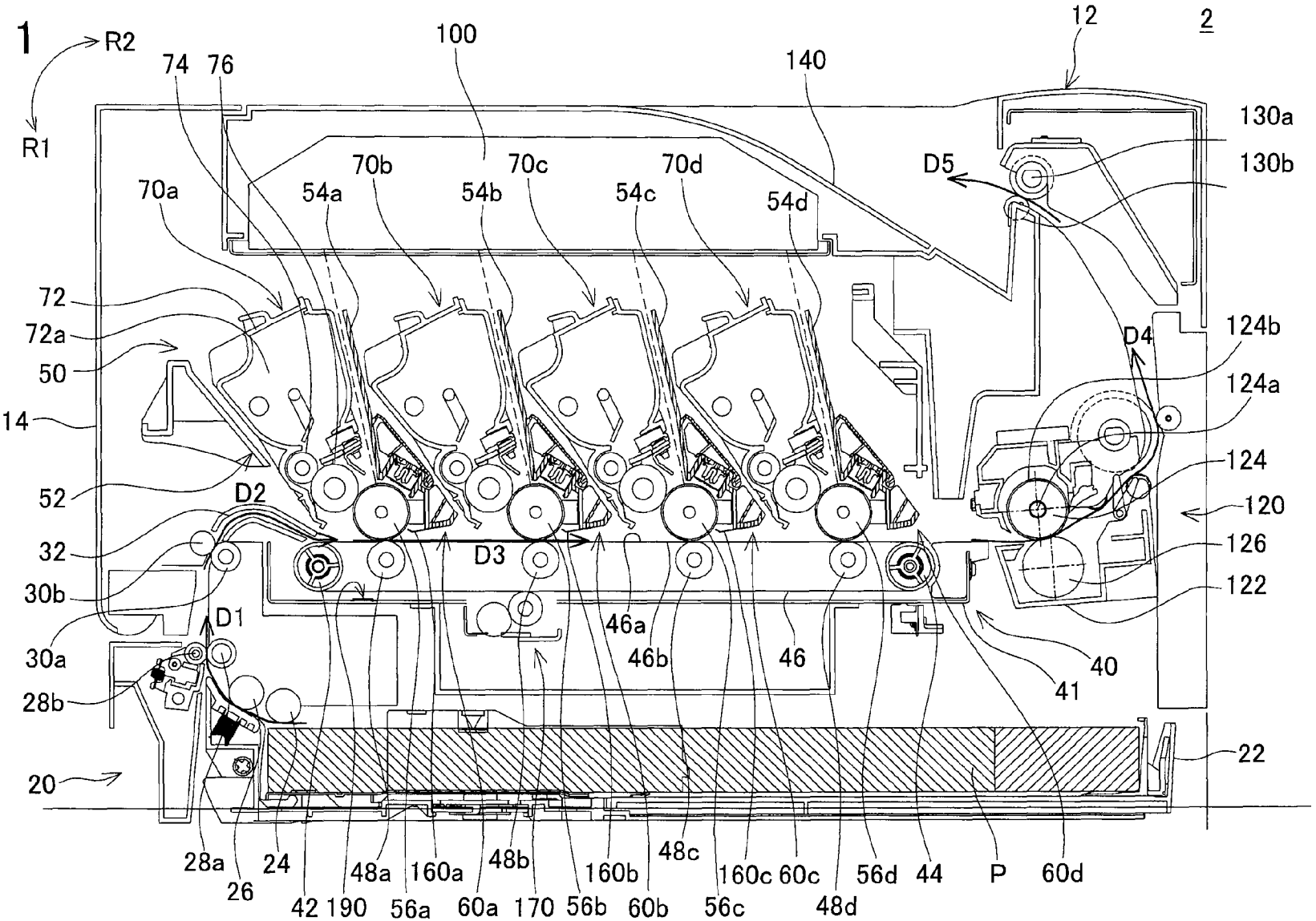
FIG. 1 is a cross sectional view of a laser printer according to one embodiment.

A laser printer 2 according to the first embodiment will be described with reference to the accompanying drawings. FIG. 1 is a cross sectional view of the laser printer 2. Hereinafter, the laser printer 2 may be simply referred to as "printer 2." In this embodiment, the left direction of FIG. 1 is the front side of the printer 2. The printer 2 has an overall casing 12. The overall casing 12 is composed of a plurality of plate members. FIG. 1 shows a front cover 14 as a member which constitutes a part of the overall casing 12. The front cover 14 is capable of rotating in a direction of arrow R1 and arrow R2. When the front cover 14 rotates in the direction of arrow R1, the overall casing 12 opens. In this state, a process cartridge 50, which will be described later, can be taken out from the overall casing 12. When the front cover 14 rotates in the direction of arrow R2, the overall casing 12 closes.

The printer 2 has a paper feeder 20, a belt unit 40, the process cartridge 50, an exposure device 100, a toner fixing device 120, and the like. These respective devices 20, 40, 50, 100, and 120 are located inside the overall casing 12. Hereinafter, configurations of the respective devices 20, 40, 50, 100, and 120 will be explained respectively.

The paper feeder 20 is provided with a paper feed tray 22 and rollers 24, 26, 28*a*, 28*b*, 30*a*, and 30*b*, and the like. The paper feed tray 22 is inserted and taken out from the front side (i.e. left side of FIG. 1) of the overall casing 12. The paper feed tray 22 is capable of housing a plurality of printing papers P in a stacked state. The top sheet of the printing papers P housed in the paper feed tray 22 comes into contact with the roller 24. When the paper feed roller 24 rotates, the top printing paper P housed in the paper feed tray 22 is sent leftward. The printing paper P that has been sent leftward is then sent upward (shown with arrow D1) by the roller 26 and the pair of rollers 28*a* and 28*b*. The printing paper P that has been sent in the direction of arrow D1 is inserted in between the pair of rollers 30*a* and 30*b*. By rotation of the pair of rollers 30*a* and 30*b*, the printing paper P is sent rightward along a rail 32 (shown with arrow D2). The printing paper P is thereby placed on the belt unit 40.

FIG. 1 schematically shows the internal configuration of the belt unit 40. The internal configuration of the belt unit 40 will be described later in detail. Here, a brief description of the configuration of the belt unit 40 will be given. The belt unit 40 has a belt case 41, a pair of rollers 42 and 44, a belt 46, and the like. The belt case 41 is fixed to the overall casing 12. The belt case 41 rotatably supports the pair of rollers 42 and 44. On the one side, the roller 42 is located at the front side (i.e. left side of FIG. 1). On the other side, the roller 44 is located at the back side (i.e. right side of FIG. 1). The belt 46 has a ring shape. The belt 46 is a so-called no-edge belt. The belt 46 is wound around the pair of rollers 42 and 44. When the one roller 44 rotates clockwise, the other roller 42 rotates in accordance therewith. That is, when the pair of rollers 42 and 44 rotates clockwise, the belt 46 rotates clockwise. The printing paper P that has been sent in the direction of arrow D2 is placed on a front surface 46*a* of the belt 46 (specifically the front surface at the upper side). The printing paper P placed on the front surface 46*a* of the belt 46 is conveyed rightward (shown with arrow D3) by the rotation of the belt 46.

On the printing paper P, letters or drawings are printed while the printing paper P is conveyed in the direction of arrow D3. Specifically, printing is carried out by transfer rollers 48*a* to 48*d*, the process cartridge 50, and the exposure device 100. The four transfer rollers 48*a* to 48*d* are located at a side of back surface 46*b* (i.e. the inner side) of the belt 46. Each of the transfer rollers 48*a* to 48*d* is in contact with the back surface 46*b* (specifically the back surface of the upper side) of the belt 46.

Figure 2:
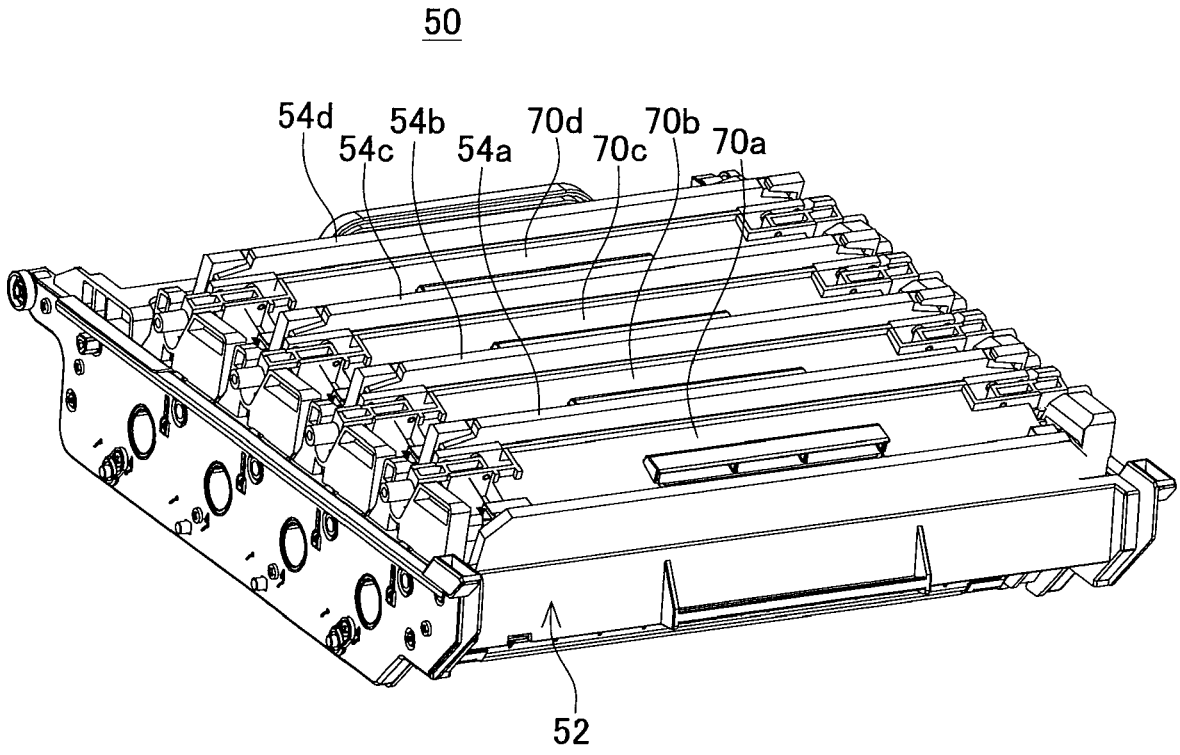
FIG. 2 is a perspective view of a process cartridge.

The process cartridge 50 has a process case 52, four developing units 70*a* to 70*d*, and the like. The process cartridge 50 is detachably inserted into the overall casing 12. When the front cover 14 is opened (by moving along arrow R1) and the process cartridge 50 is slid toward the left direction of FIG. 1, the process cartridge 50 can be removed from the overall casing 12. FIG. 2 is a perspective view of the process cartridge 50. The process case 52 is capable of detachably housing four developing units 70*a* to 70*d*. The process case 52 has partition boards 54*a* to 54*d* which extend almost in the vertical direction. The process case 52 is partitioned into four rooms by the partition boards 54*a* to 54*d*. A single developing unit (any one of the developing units 70*a* to 70*d*) is housed in each room.

Each of the developing units 70*a* to 70*d* is detachably attached to the process case 52. The developing unit 70*a* has a toner case 72, a supply roller 74, a developing roller 76, and the like. A toner room 72*a* is formed inside the toner case 72. Black toner may be housed in the toner room 72*a* of the developing unit 70*a*. The supply roller 74 and the developing roller 76 are rotatably attached to the toner case 72. The supply roller 74 is located so as to face the toner room 72*a*. The developing roller 76 is in contact with the supply roller 74. Further, the developing roller 76 is in contact with a photoreceptor 56*a*. The other developing units 70*b* to 70*d* also have the same configuration as that of the developing unit 70*a*. In FIG. 1, symbols of components (a toner case, a toner room, a supply roller, a developing roller, and the like) of the other developing units 70*b* to 70*d* are omitted. For example, Yellow toner may be housed in the toner room of the developing unit 70*b*. Magenta toner may be housed in the toner room of the developing unit 70*c*. Cyan toner may be housed in the toner room of the developing unit 70*d*. The printer 2 according to this embodiment carries out color printing on the printing paper P by utilizing the aforementioned four-color toner.

As shown in FIG. 1, the process cartridge 50 is provided with four photoreceptors 56*a* to 56*d*, four chargers 60*a* to 60*d*, and the like. Each of the photoreceptors 56*a* to 56*d* is rotatably attached to the process case 52. The photoreceptor 56*a* faces the transfer roller 48*a* with the belt 46 in between. Similarly, the other photoreceptors 56*b* to 56*d* also face the corresponding transfer rollers 48*b* to 48*d* in the same manner. The printing paper P that has been sent in the direction of arrow D3 passes through between the photoreceptors 56*a* to 56*d* and the transfer rollers 48*a* to 48*d*. During this course, a bias voltage is applied to the transfer rollers 48*a* to 48*d*. Thus, toner maintained on each of the photoreceptors 56*a* to 56*d* is transferred onto the printing paper P.

Each of the chargers 60*a* to 60*d* is fixed to the process case 52. The charger 60*a* faces the photoreceptor 56*a*. Similarly, the other chargers 60*b* to 60*d* also face the corresponding photoreceptors 56*b* to 56*d*. Each of the chargers 60*b* to 60*d* positively charges the outer surface of each of the photoreceptors 56*a* to 56*d* by corona discharging.

The exposure device 100 is located above the process cartridge 50. The exposure device 100 is fixed to the overall casing 12. The exposure device 100 has a light source which is omitted from the drawing. A laser beam is emitted from the light source. The laser beam supplied from the light source reaches the photoreceptors 56*a* to 56*d* of the process cartridge 50 respectively. FIG. 1 shows the routes of the laser beam to be irradiated from the exposure device 100 by dashed lines. Routes of four laser beams for exposing each of the four photoreceptors 56*a* to 56*d* are shown. Each laser beam passes through a space formed between the developing units 70*a* to 70*d* and the partition boards 54*a* to 54*d*. Irradiation of the laser beams to the photoreceptors 56*a* to 56*d* may cause exposure of the photoreceptors 56*a* to 56*d* in a various predetermined patterns.

Operation of toner transfer onto the printing paper P will be described. Toner in the toner room 72*a* adheres to the supply roller 74. The toner adhered to the supply roller 74 is positively charged by the friction between the supply roller 74 and the developing roller 76. The positively charged toner covers the outer surface of the developing roller 76. On the other hand, outer surfaces of the photoreceptors 56*a* to 56*d* are positively charged by the chargers 60*a* to 60*d*. The positively charged photoreceptors 56*a* to 56*d* receive the laser beams irradiated from the exposure device 100. Thus, predetermined parts of the outer, peripheral surfaces of the photoreceptors 56*a* to 56*d* are exposed. As the result, electric potential of the exposed parts of the photoreceptors 56*a* to 56*d* is lowered. It should be noted that the parts to be exposed in this process may differ depending on the contents to be printed. Electrostatic latent images based on the contents to be printed are formed on the photoreceptors 56*a* to 56*d*. Thus, the photoreceptors 56*a* to 56*d* retain the electrostatic latent images. The toner coating the developing roller 76 is supplied to the exposed parts of the photoreceptors 56*a* to 56*d*. The toner thereby adheres to the respective photoreceptors 56*a* to 56*d*. In this process, toner does not adhere to the unexposed parts of the photoreceptors 56*a* to 56*d*. As the result, the electrostatic latent images formed on the photoreceptors 56*a* to 56*d* are thereby developed in a visible manner. Visible images retained at the photoreceptors 56*a* to 56*d* are transferred onto the printing paper P while the printing paper P is being conveyed between the photoreceptors 56*a* to 56*d* and the transfer rollers 48*a* to 48*d*. At this time, a bias voltage is applied to the transfer rollers 48*a* to 48*d*. The difference in electric potential between the photoreceptors 56*a* to 56*d* and the transfer rollers 48*a* to 48*d* enhances the transfer of toner onto the printing paper P. Through each of the processes described above, desired images (may it be printed letters or drawings) are printed on the printing paper P.

Subsequently, a configuration of the toner fixing device 120 will be described. The toner fixing device 120 is located at the rear (i.e. right side of FIG. 1) of the process cartridge 50. The toner fixing device 120 is provided with a frame 122, a heating roller 124, and a pressure roller 126. The frame 122 rotatably supports the heating roller 124 and the pressure roller 126. The heating roller 124 has a halogen lamp 124*a* and a metal tube 124*b*. The halogen lamp 124*a* heats the metal tube 124*b*. The pressure roller 126 is resiliently affixed toward the side of the heating roller 124 by a mechanism which is omitted from the drawing. The printing paper P that has been conveyed by the belt unit 40 is inserted in between the heating roller 124 and the pressure roller 126. The printing paper P is thereby heated by the heating roller 124 which is heated beforehand to a high temperature. Thus, the toner transferred onto the printing paper P is fixed by the heat and pressure. The printing paper P which has passed through the toner fixing device 120 is then sent in the direction towards the upper right (cf. arrow D4).

A pair of rollers 130*a* and 130*b* is located above the toner fixing device 120. The rollers 130*a* and 130*b* send the printing paper P leftward (cf. arrow D5), after having been transported via the toner fixing device 120. The printing paper P is sent out to an outside of the overall casing 12. An exhaust paper tray 140 is formed on an upper surface of the overall casing 12. The printing paper P that has been sent out to the outside of the overall casing 12 is exhausted on the exhaust paper tray 140.

Figure 3:
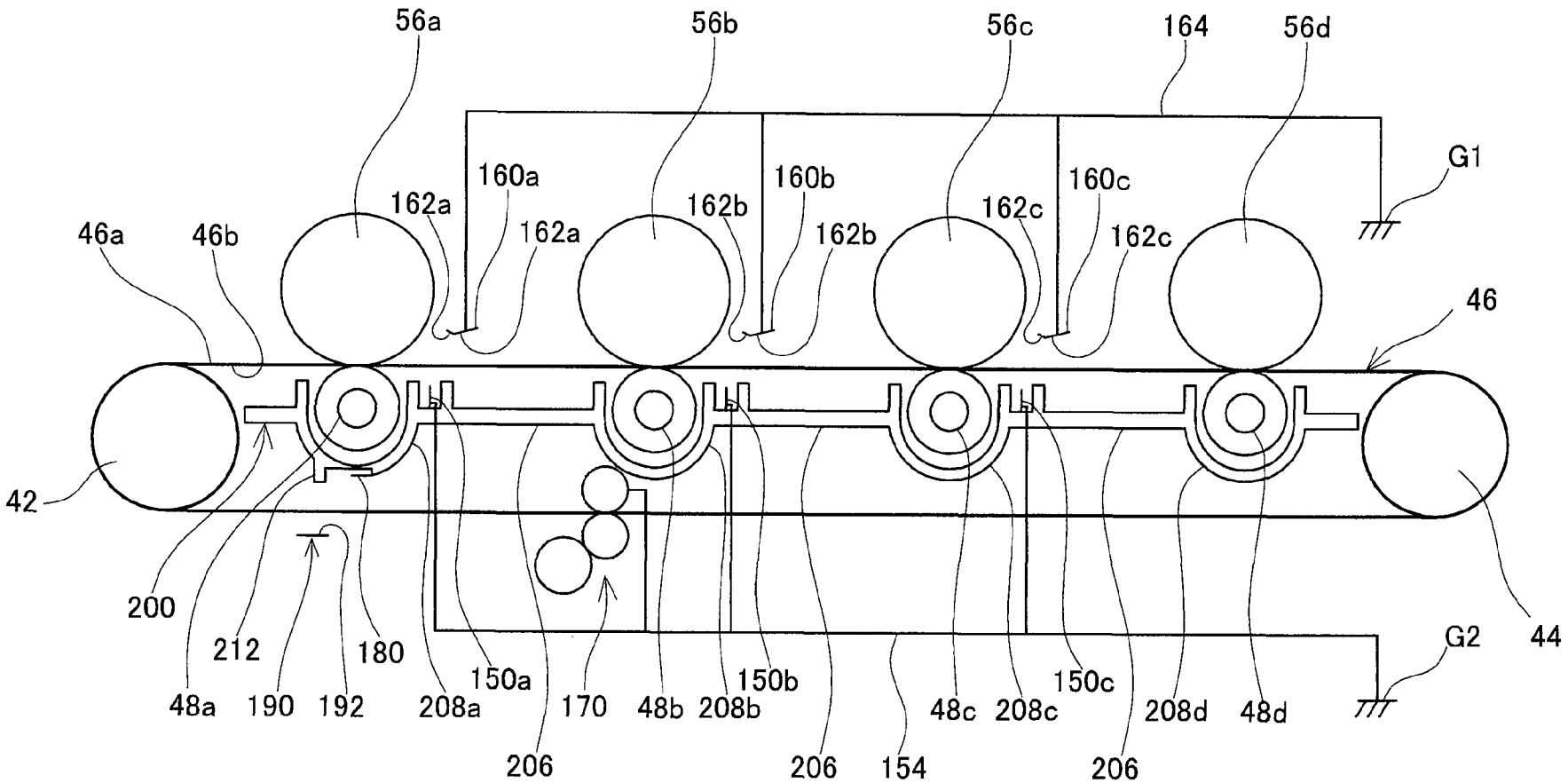
FIG. 3 is a schematic view of internal and peripheral configurations of a belt unit.

Subsequently, the internal and peripheral configurations of the belt unit 40 will be described in detail. FIG. 3 shows configurations of the belt unit 40 and its surrounding configurations. The printer 2 is provided with a plate member 200 which is located at the side of the back surface 46*b* (i.e. inside the loop) of the belt 46. It should be noted that the plate member 200 is not shown in FIG. 1. The plate member 200 is fixed to the overall casing 12. The plate member 200 has a horizontal part 206 extending in the horizontal direction (i.e. cross direction), four concave portions 208*a* to 208*d* protruding downward from the horizontal part 206, and the like. Each of the concave portions 208*a* to 208*d* opens upward. Furthermore, each of the concave portions 208*a* to 208*d* has a shape of circular arc as shown in the horizontal sectional angle thereof. The transfer roller 48*a* is inserted in the concave portion 208*a*. Similarly, the transfer rollers 48*b* to 48*d* are also inserted into the corresponding other concave portions 208*b* to 208*d*. The plate member 200 rotatably supports each of the four transfer rollers 48*a* to 48*d*.

The printer 2 is provided with four charge removal needles 150*a* to 150*c* and 180 and four conductive films 160*a* to 160*c* and 190. It should be noted that the charge removal needles 150*a* to 150*c* and 180 are not shown in FIG. 1. The charge removal needles 150*a* to 150*c* and 180 are made of conductive metal. The conductive films 160*a* to 160*c* and 190 are made of conductive resin. The charge removal needles 150*a* to 150*c* are connected to a ground G2 through a wiring 154. Similarly, the charge removal needle 180 is also connected to a ground through wiring which is omitted from the drawing. The conductive films 160*a* to 160*c* are connected to a ground G1 through wiring 164. Similarly, the conductive film 190 is also connected to a ground through a wiring which is not shown in the drawing. It should be noted that each of the grounds G1 and G2 described above may be grounded or may each be of a constant electric potential.

Figure 4:
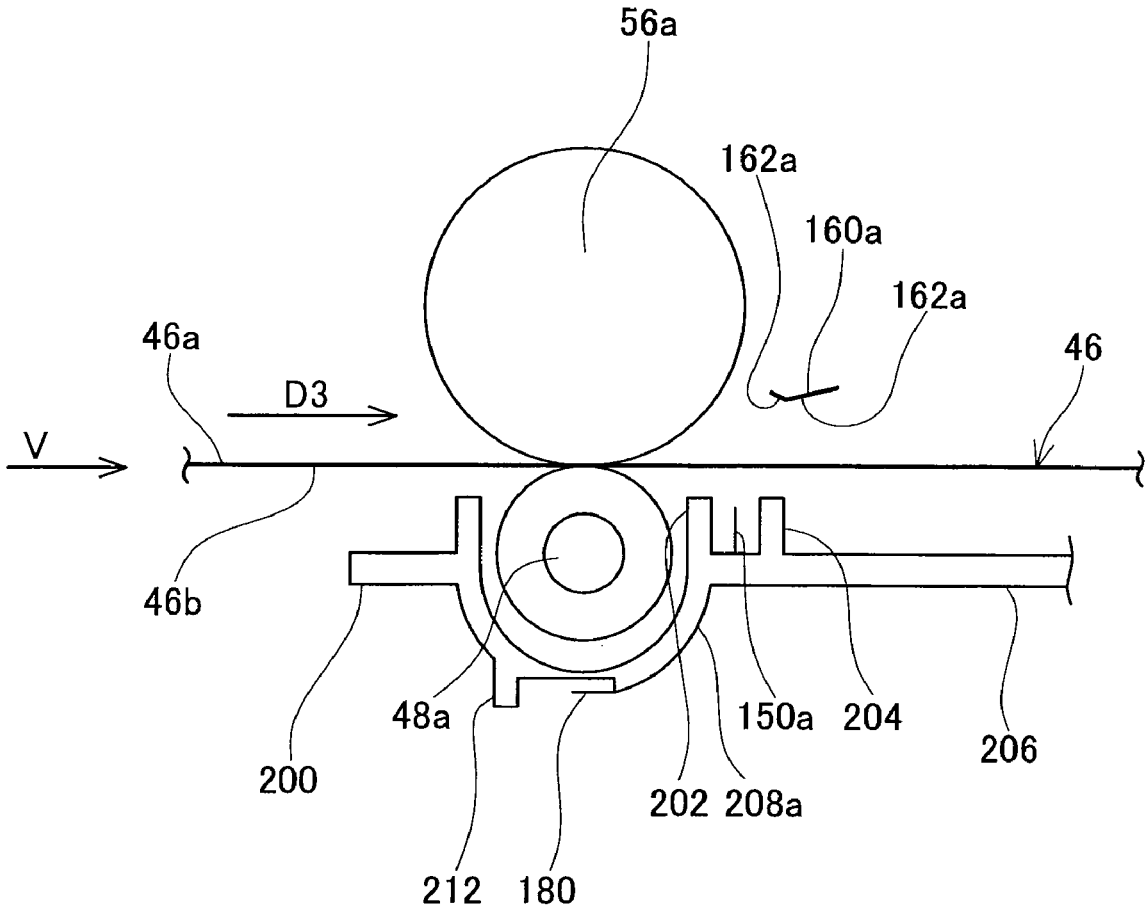
FIG. 4 is an enlarged view of the surrounding configuration of a photoreceptor.
Figure 5:
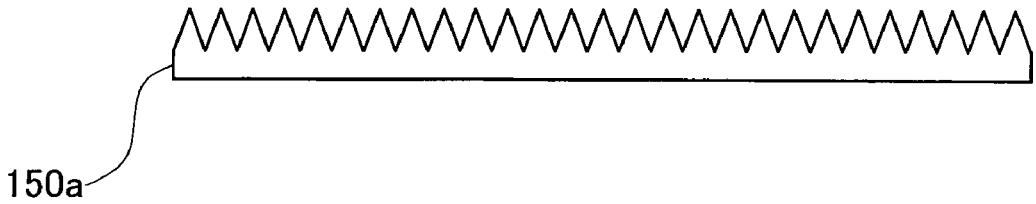
FIG. 5 shows a charge removal needle which is viewed in the direction of an arrow V shown in FIG. 4.

In the direction of conveying the printing paper P (i.e. right direction of FIG. 3), the charge removal needle 150*a* and the conductive film 160*a* are located between the adjacent photoreceptor 56*a* and the photoreceptor 56*b*. Furthermore, it may also be said that in the direction of conveying the printing paper P (i.e. right direction of FIG. 3), the charge removal needle 150*a* is located at the upstream side and the conductive film 160*a* is located at the downstream side. FIG. 4 is an enlarged view of the surroundings of the photoreceptor 56*a*. The charge removal needle 150*a* is located at the side of the back surface 46*b* of the belt 46 and in the vicinity of the back surface 46*b*. Furthermore, the charge removal needle 150*a* is fixed to the plate member 200. The charge removal needle 150*a* is elongated in the vertical direction of FIG. 4. This is clearly shown in FIG. 5. FIG. 5 shows the charge removal needle 150*a* which is viewed from the direction of arrow V of FIG. 4. The length of the charge removal needle 150*a* orthogonally extending from the page surface of FIG. 4 (in another words, the length in the 'widthwise' direction as shown as the left and right direction in FIG. 5) is slightly shorter than the length of the belt 46 in the 'widthwise' direction (the orthogonal direction with respect to the page surface of FIG. 4). The charge removal needle 150*a* has a plurality of needle portions that taper off to a point (i.e. upper edge) respectively. It can be said that the charge removal needle 150*a* has a shape of saw blade. Each needle portion of the charge removal needle 150*a* extends upward. As shown in FIG. 4, each needle portion of the charge removal needle 150*a* extends toward the back surface 46*b* of the belt 46. The point (i.e. upper edge) of each needle portion of the charge removal needle 150*a* faces the back surface 46*b* of the belt 46.

The plate member 200 has a plurality of wall parts 202 and 204, which extend upward from the horizontal part 206, and the like. In the predetermined direction of conveying the printing paper P, the wall part 202 is located upstream compared to the charge removal needle 150*a*. Furthermore, the wall part 202 extends upward along the charge removal needle 150*a*. Moreover, the wall part 202 protrudes upward beyond the charge removal needle 150*a*. It may also be said that the height of the wall part 202 is almost equal to but slightly higher than the height of the charge removal needle 150*a*. Furthermore, the length of the wall part 202 in the orthogonal direction with respect to the page surface of FIG. 4 (i.e. in the 'widthwise' direction of the wall part 202) is almost equal to but slightly longer than the length of the charge removal needle 150*a* in the orthogonal direction with respect to FIG. 4 (i.e. the width of the charge removal needle 150*a*). Consequently, when it is viewed in the direction of arrow V of FIG. 4, the charge removal needle 150*a* is hidden behind the wall part 202. Meanwhile, in the direction of conveying the printing paper P, the wall part 204 is located downstream as compared to the charge removal needle 150*a*. The wall part 204 has almost the same shape as that of the wall part 202. In other words, the wall part 204 extends upward along the charge removal needle 150*a*, and protrudes upward beyond the charge removal needle 150*a*.

The conductive film 160*a* is located at the side of the front surface 46*a* (front surface 46*a* at the upper side) of the belt 46 and in the vicinity of the front surface 46*a*. The conductive film 160*a* is fixed to the process case 52. This is shown clearly in FIG. 1. The length of the conductive film 160*a* in the orthogonal direction with respect to the page surface of FIG. 4 (i.e. in the 'widthwise' direction of the conductive film 160*a*) is slightly shorter than the 'width' or the length of the charge removal needle 150*a* in the orthogonal direction with respect to the page surface of FIG. 4. It may also be said that the width of the conductive film 160*a* is almost the same as that of the belt 46. The conductive film 160*a* has a surface 162 which faces the front surface 46*a* of the belt 46. As shown in FIG. 4, the conductive film 160*a* according to this embodiment has a shape of being slightly bent. However, the surface 162*a* of the conductive film 160*a* may well be regarded as being formed almost flat. The surface 162*a* has broadened dimension along a horizontal surface. More specifically, the surface 162*a* extends along the orthogonal direction with respect to the page surface of FIG. 4, and also extends along the horizontal direction of FIG. 4. The surface 162*a* is almost parallel with the front surface 46*a* of the belt 46. In other words, the surface 162*a* is almost parallel with respect to the horizontal surface thereof. Preferably, the surface 162*a* has a length longer than 10 mm in the horizontal direction of FIG. 4. This length of the conductive film 160*a*, which may also be said as the length in the 'depthwise' or the 'proceeding' direction with respect to the predetermined paper conveying direction, allows effective control of unevenness of electric potential of the belt 46. Furthermore, the conductive film 160*a* is located so as to face the wall part 204 across the belt 46. In other words, viewing the printer 2 in ground plan, at least a part of the conductive film 160*a* faces at least a part of the wall part 204.

As shown In FIG. 3, in the paper conveying direction (i.e. right direction of FIG. 3), the charge removal needle 160*b* and the conductive film 160*b* are located between the photoreceptor 56*b* and the photoreceptor 56*c*. In the paper conveying direction, the charge removal needle 150*b* is located at the upstream side, and the conductive film 160*b* is located at the downstream side. Further, in the paper conveying direction, the charge removal needle 150*c* and the conductive film 160*c* are located between the photoreceptor 56*c* and the photoreceptor 56*d*. Likewise, the charge removal needle 150*c* is located at the upstream side, and the conductive film 160*c* is located at the downstream side. The charge removal needles 150*b* and 150*c* have the same configuration as that of the charge removal needle 150*a*. Peripheral configurations of the electric removal needles 150*b* and 150*c* (e.g. wall part and the like) are also the same as that of the charge removal needle 150*a*. Further, the conductive films 160*b* and 160*c* have the same configuration as that of the conductive film 160*a*. It should be noted that in the direction of conveying the printing paper P (right direction of FIG. 3), no charge removal needle nor a conductive film are located at the downstream side of the rearmost photoreceptor 56*d*.

The printer 2 has a belt cleaning mechanism 170. The belt cleaning mechanism 170 is located at the side of the front surface 46*a* (specifically, at the front surface 46*a* on the lower side) of the belt 46. The belt cleaning mechanism 170 is connected to a power source which is not shown in the drawing. The belt cleaning mechanism 170 statically removes paper crumbs and toner, which are adhered to the belt, by utilizing an electric field (by utilizing an electric potential difference between the belt cleaning mechanism 170 and the belt 46). The belt cleaning mechanism 170 has three rollers. A roller located at the side of the back surface 46*b* of the belt 46 is connected to the ground G2.

In a direction of movement of the belt 46 (i.e. the rotating direction), the charge removal needle 180 and the conductive film 190 are located between the belt cleaning mechanism 170 and the photoreceptor 56*a*. In the direction of movement of the belt 46, the charge removal needle 180 is located at the upstream side, and the conductive film 190 is located at the downstream side. The charge removal needle 180 is located at the side of the back surface 46*b* of the belt 46. The charge removal needle 180 is fixed to the plate member 200. Specifically, the charge removal needle 180 is fixed to the concave portion 208*a* into which the transfer roller 48*a* is inserted. The charge removal needle 180 has the same shape as that of the charge removal needle 150*a* shown in FIG. 5. However, the charge removal 180 extends in the horizontal direction. In this point, the charge removal needle 180 differs from the charge removal needle 150*a* and the like. Each needle of the charge removal needle 180 extends leftward. Also in this arrangement, it can be said that a point (left edge) of each needle portion of the electric removal needle 180 faces the back surface 46*b* of the belt 46.

The plate member 200 has a wall part 212 extending downward from the concave portion 208 into which the transfer roller 48*a* is inserted. In the rotation direction of the belt 46, the wall part 212 is located downstream compared to the electric removal needle 180. The wall part 212 has almost the same shape as those of the wall parts 202 and 204. However, the wall part 212 has shorter length, or height than the wall parts 202 and 204 (that is, the length in the vertical direction of FIG. 3 or the 'heightwise' direction with respect to the rotation direction is short). In this point, the wall part 212 differs from the wall parts 202 and 204. The wall part 212 protrudes downward beyond the electric removal needle 180.

The conductive film 190 is located at the side of the front surface 46*a* (front surface 46*a* at the lower side) of the belt 46 in the vicinity of the front surface 46*a*. The conductive film 190 is fixed to the belt case 41. This state is clearly shown in FIG. 1. The conductive film 190 has almost the same configuration as those of the conductive film 160*a* described above and the like. The conductive film 190 has a surface 192 which faces the front surface 46*a* of the belt 46. The surface 192 has a broadened dimension along the horizontal surface (that is, along the surface of the belt 46 on which the printing paper P is to be placed). The conductive film 190 is located so as to face the wall part 212 across the belt 46. More specifically, in viewing the printer 2 in ground plan, at least a part of the conductive film 190 faces at least a part of the wall part 212.

Detailed description of the configuration of the printer 2 according to the embodiment has been given. In the printer 2, a combination of the charge removal needles 150*a* to 150*c* and the conductive films 160*a* to 160*c* is located among the respective photoreceptors 56*a* to 56*c*. As a result, by the time when the belt 46, which has been electrostatically charged by a photoreceptor at the upstream side (e.g. the photoreceptor 56*a*), reaches the next photoreceptor at the downstream side (e.g. the photoreceptor 56*b*), the electric potential of the belt 46 is stabilized by the aforementioned mechanism arranged in between the adjacent photoreceptors. This effect will be described below.

Figure 6:
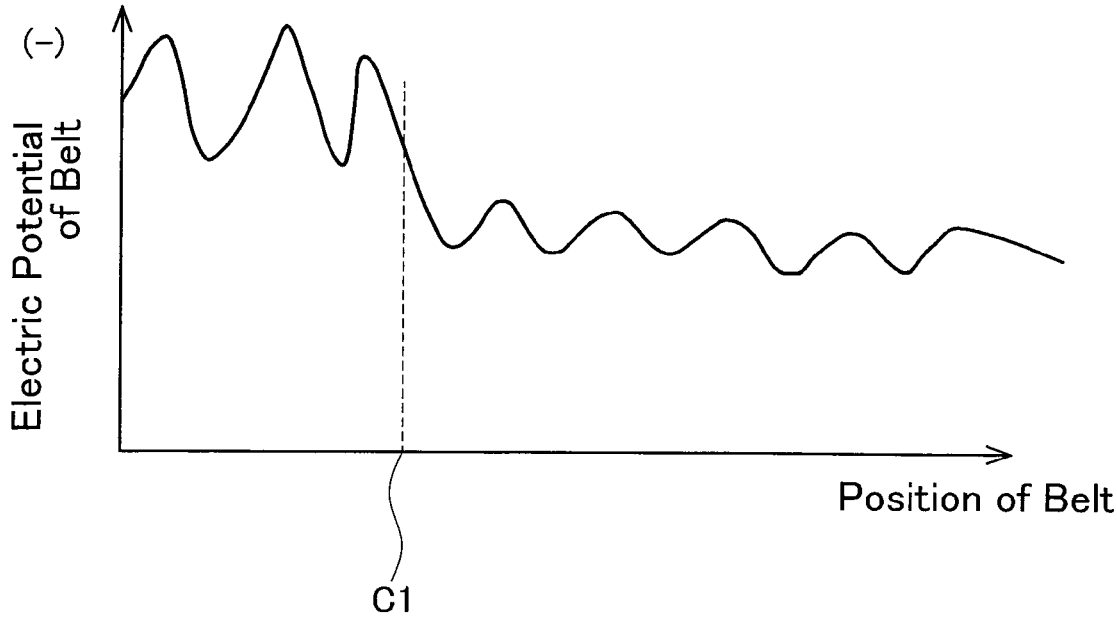
FIG. 6 shows a change of electric potential of a belt with mere utilization of the charge removal needle.
Figure 7:
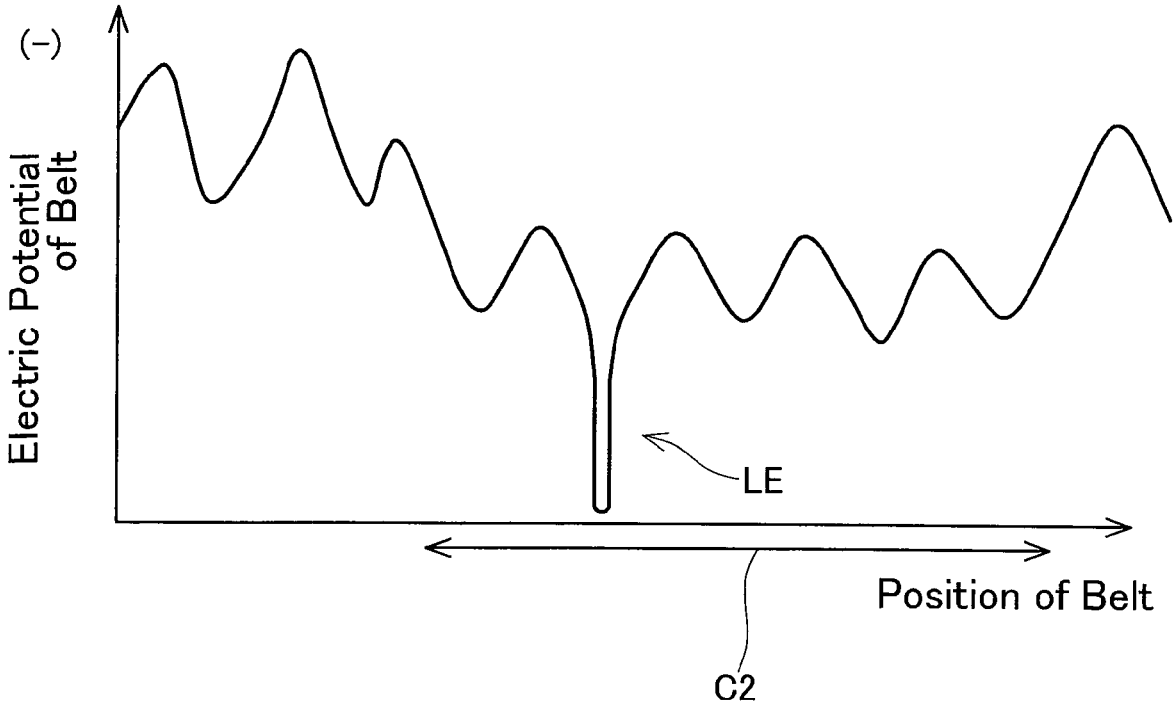
FIG. 7 shows a change of electric potential of the belt with mere utilization of a conductive film.
Figure 8:
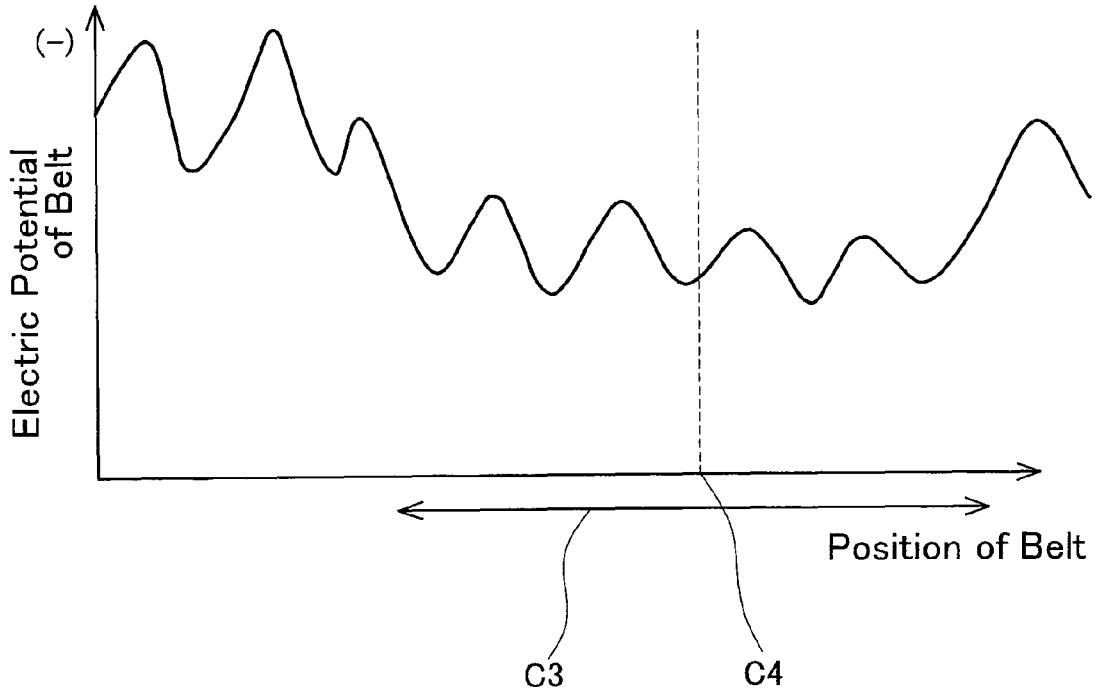
FIG. 8 shows a change of electric potential of the belt with utilization of both the conductive film located at an upstream side and the charge removal needle located at a downstream side.
Figure 9:
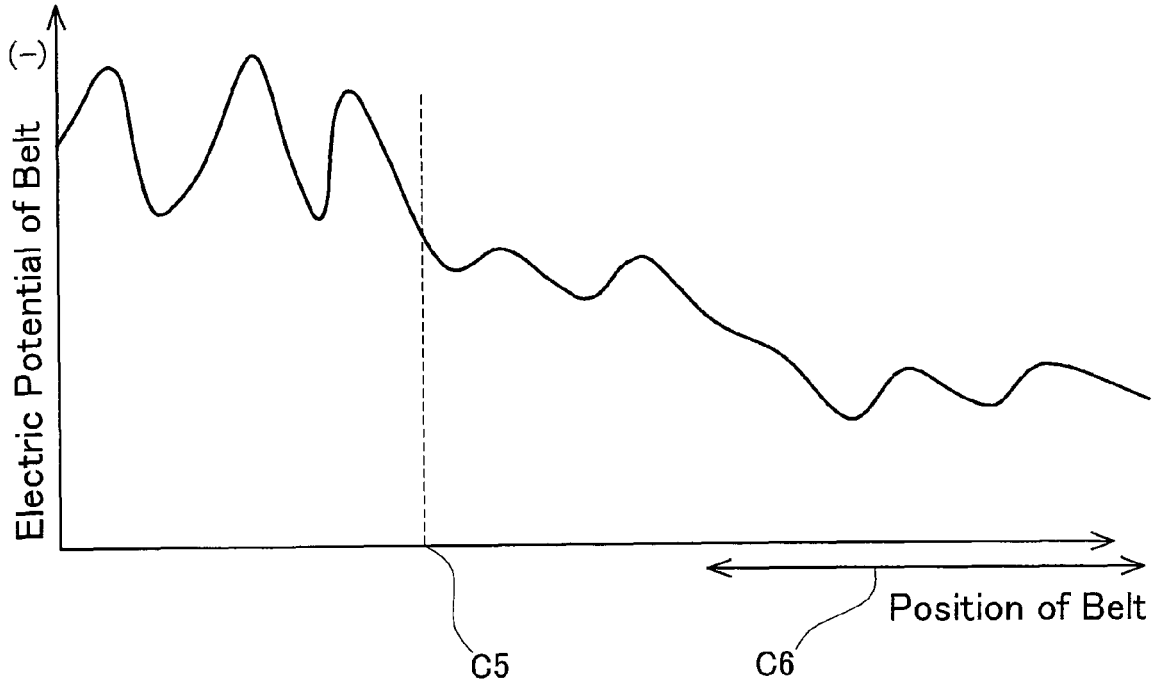
FIG. 9 shows a change of electric potential of the belt with utilization of both the charge removal needle located at the upstream side and the conductive film located at the downstream side.

FIG. 6 shows the change of electric potential of the belt in a case where no conductive film is utilized, but only a charge removal needle is utilized. The horizontal axis shows the position of the belt in the paper conveying direction. The vertical axis shows electric potential of the belt at the respective positions. A reference symbol C1 of FIG. 6 shows the position of the charge removal needle. In a case where only the charge removal needle is utilized, electric charges can be efficiently removed from the belt, however, relatively a large unevenness of electric potential remains on the belt. FIG. 7 shows the change of electric potential of the belt in a case where no charge removal needle is utilized, but only a conductive film is utilized. A reference symbol C2 of FIG. 7 shows an area where the conductive film is located. In a case where only the conductive film is utilized, electric potential can be reduced as a whole, however, the unevenness of electric potential is enhanced due to the electric discharge resulting from insufficient removal of electric charges (refer to a reference symbol LE). FIG. 8 shows the change of electric potential of the belt in a case where both of the charge removal needle and the conductive film are utilized. A reference symbol C3 of FIG. 8 shows the area where the conductive film is located, and a reference symbol C4 of FIG. 8 shows the position of the charge removal needle. More specifically, in this example, the conductive film is located at the upstream side, and the charge removal needle is located at the downstream side. In a case where the conductive film is located at the upstream side, since the electric potential of the belt is reduced in advance by the conductive film, the electric potential difference between the belt and the charge removal needle becomes small; this resulted in the charge removal needle not being able to efficiently eliminate the electric charges from the belt. Consequently, a relatively large unevenness of the electric potential remained at the belt. FIG. 9 shows the change of electric potential of the belt in a case where both of the charge removal needle and the conductive film are utilized. A reference symbol C5 of FIG. 9 shows the position of the charge removal needle, and a reference symbol C6 shows the area where the conductive film is located. More specifically, in this example, the charge removal needle is located at the upstream side, and the conductive film is located at the downstream side. In this case, the electric potential is efficiently removed from the belt by the charge removal needle. Then, by the conductive film, the electric potential of the belt is further reduced; and unevenness of the electric potential is successfully controlled. As it is clear, in the example shown in FIG. 9, among FIGS. 6 through 9, the electric potential of the belt is reduced in the most degree and unevenness of electric potential of the belt is controlled most effectively.

In this embodiment, electric potential of the belt 46 (and electric potential of the printing paper P) can be stabilized by the time when the belt 46 reaches a photoreceptor (e.g., the photoreceptor 56*b*) at the downstream side. Undesirable blobbing and uneven diffusion of toner from the photoreceptor at the downstream side that are caused by the unevenness of electric potential of the belt 46 can be effectively controlled. As a result, the unevenness of color density of an image to be formed on the printing paper P is prevented.

The printer 2 according to this embodiment is provided with the belt cleaning mechanism 170 for cleaning the belt 46 by utilizing electric field. There is a possibility that unevenness of electric potential is caused on the belt 46 by the electrostatical charge from the belt cleaning mechanism 170 to the belt 46. This unevenness of electric potential is also efficiently removed by the charge removal needle 180 and the conductive film 190. Therefore, unevenness of extent of toner transfer from the photoreceptor 56*a* is controlled.

In a case of utilizing an acicular member (e.g. the charge removal needle 180) so as to remove static electricity from the belt 46, the charge removal needle 180 is preferably located out of reach of a user. In this embodiment, the belt 46 has a ring shape and the electric removal needle 180 is located at the back surface side of the belt 46. According to this configuration, the electric removal needle 180 can be located inside the circular belt 46.

Further, in the printer 2 according to this embodiment, because of the wall parts 202, 204, and 212 and the like, contact of the belt 46 with the charge removal needles 150*a* to 150*c* and 180 is prevented even when the belt 46 is bent or sagged. Damaging of the belt 46 due to the charge removal needles 150*a* to 150*c* and 180 is prevented. Further, the conductive films 160*a* to 160*c* and 190 face the wall parts 204 and 212 and the like. Thus, an electric discharge from the belt 46 to the wall parts 204 and 212 is controlled. Occurrence of large unevenness of electric potential on the belt 46 due to such an electric discharge is prevented.

Additionally, preferable arrangement of charge removal needles 150*a* to 150*c* and 180, and the conductive films 160*a* to 160*c* and 190 will be described. Preferably, a distance between the charge removal needles 150*a* to 150*c* and 180 and the back surface 46*b* of the belt 46 is within a range of 1 to 5 mm. Such distance allows excellent performance in removing static electricity. Further, preferably a distance between the charge removal needles 150*a* to 150*c*, and 180 and the wall parts 202, 204, and 212 (for example, the distance between the charge removal needle 150*a* and the wall part 202) is within a range of 0.5 to 3 mm. If the distance is less than 0.5 mm, there is a possibility of degrading the performance in the potential removal. Also, if the distance is more than 3 mm, there is a possibility that, in a case where the belt 46 is bent or sagged, the belt 46 may come into contact with one or more of the electric removal needles 150*a* to 150*c* and 180, instead of the wall parts 202, 204, and 212. As long as the distance is within the range described above, both of the excellent performance in potential removal and the protection of the belt 46 are realized. Further, a distance between the conductive films 160*a* to 160*c* and 190 and the front surface 46*a* of the belt 46 is preferably within a range of 1 to 5 mm. As long as the distance is within the range, excellent electric potential stabilization performance is realized.

Second Embodiment

Figure 10:
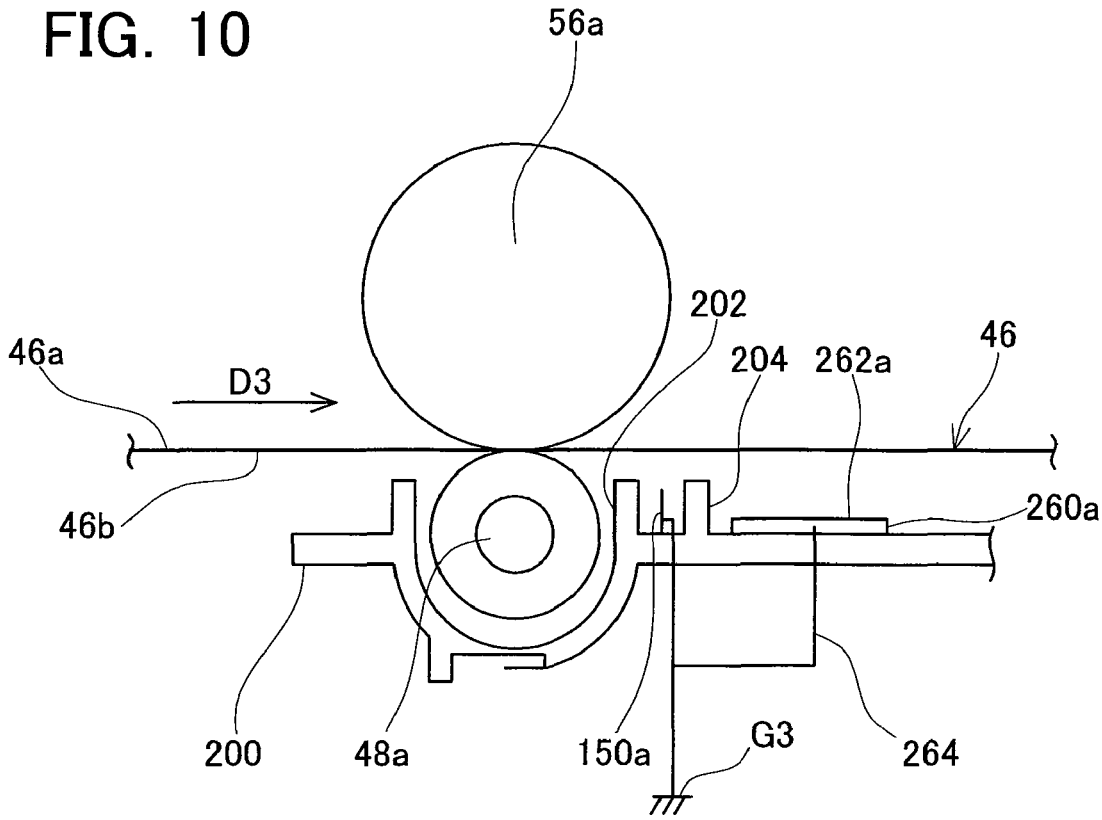
FIG. 10 is an enlarged view of the surrounding configuration of the photoreceptor (the second embodiment).

FIG. 10 is an enlarged view of a surrounding configuration of the photoreceptor 56*a*. In this embodiment, a plate type conductive member 260*a* is utilized as a substitute for a conductive film. The plate type conductive member 260*a* is made of conductive metal. The plate type conductive member 260*a* is located at the side of the back surface 46*b* of the belt 46. In the direction of conveying the printing paper P, the charge removal needle 150*a* is located at the upstream side, and the plate type conductive member 260*a* is located at the downstream side. The plate type conductive member 260*a* is located at the downstream location compared to the wall part 204. The plate type conductive member 260*a* is fixed to the plate member 200. The plate type conductive member 260*a* has a surface 262*a* facing the back surface 46*b* of the belt 46. This surface 262*a* is in parallel with the back surface 46*b* of the belt 46. The length of the surface 262*a* in an orthogonal direction with respect to the page surface of FIG. 10 (that is, the 'width' of the surface 262*a* with respect to the direction of arrow D3) is slightly shorter than that of the belt 46 in the aforesaid orthogonal direction. The length of the surface 262*a* in the horizontal direction shown in FIG. 10, or the length in 'depthwise' direction with respect to the direction in which paper is conveyed, is over 10 mm similarly to the first embodiment. The charge removal needle 150*a* and the plate type conductive member 260*a* are connected to a ground G3 through a wiring 264.

Also in this embodiment, electric potential of the belt 46 (and electric potential of the printing paper P) can be stabilized by the time when the belt 46 reaches a photoreceptor (for example, the photoreceptor 56*b*) at the downstream side.

Third Embodiment

Figure 11:
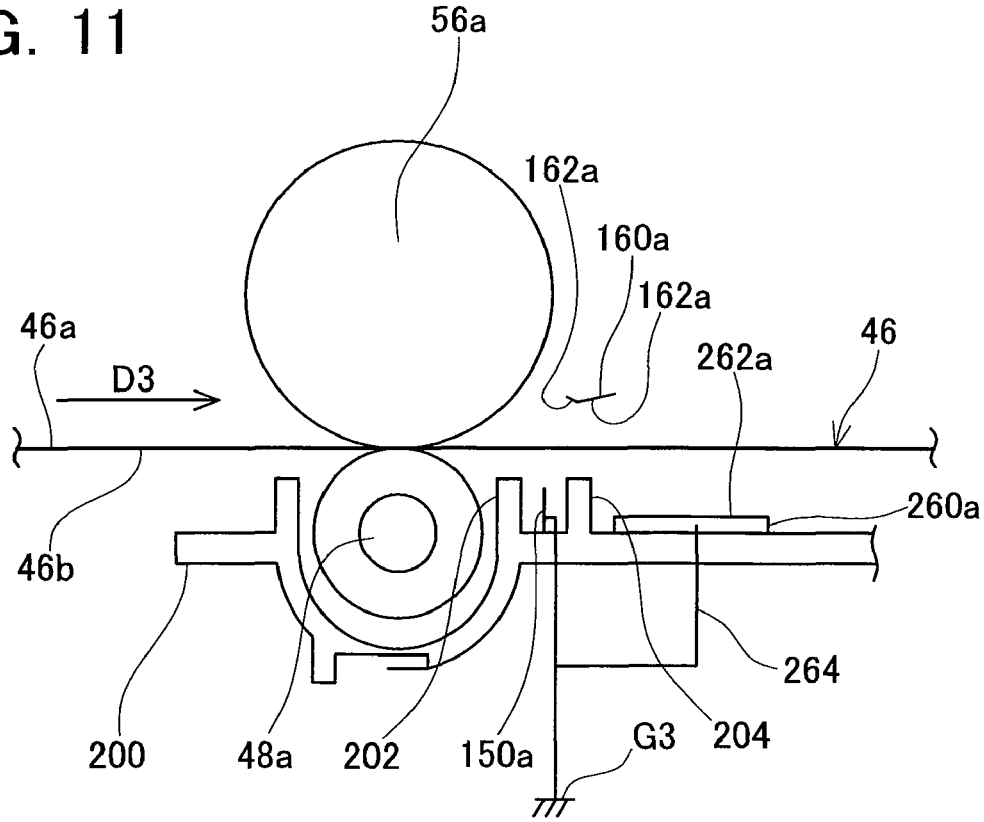
FIG. 11 is an enlarged view of the surrounding configuration of the photoreceptor (the third embodiment).

FIG. 11 is an enlarged view of a surrounding configuration of the photoreceptor 56*a*. In this embodiment, both of the plate type conductive member 260*a* and the conductive film 160*a* are used. In a direction of conveying the printing paper P, the charge removal needle 150*a* is located at the upstream side, the conductive film 160*a* is located at the downstream side, and the plate type conductive member 260*a* is located further downstream compared to the conductive film 160*a*.

According to this embodiment, after the electric charges are removed from the belt 46 by the charge removal needle 150*a*, unevenness of the electric potential of the belt 46 is removed by the two conductive members 160*a* and 260*a*. Therefore, unevenness of electric potential of the belt 46 is efficiently controlled.

Fourth Embodiment

Figure 12:
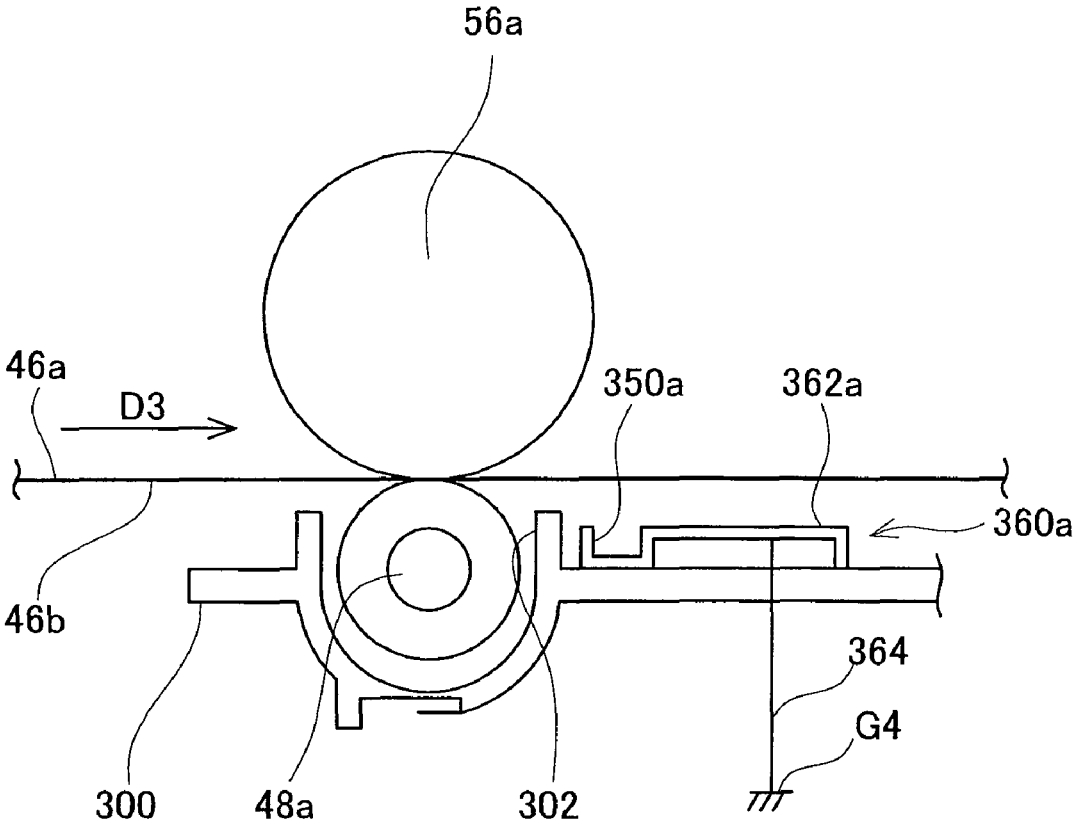
FIG. 12 is an enlarged view of the surrounding configuration of the photoreceptor (the fourth embodiment).

FIG. 12 is an enlarged view of a surrounding configuration of the photoreceptor 56*a*. A charge removal needle 350*a* and a plate type conductive member 360*a* according to this embodiment are formed by processing (e.g. bending, cutting, and the like) a single metal plate. In other words, the charge removal needle 350*a* and the plate type conductive member 360*a* are integrally configured. The charge removal needle 350*a* has a shape of saw blade similarly to each of the embodiments described above. The plate type conductive member 360*a* has a surface 362*a* which faces the back surface 46*b* of the belt 46. This surface 362*a* is in parallel with the back surface 46*b* of the belt 46. The length of the surface 362*a* in an orthogonal direction with respect to the page surface of FIG. 12 (i.e. the 'widthwise' length) is slightly shorter than the length of the belt 46 in the aforementioned orthogonal direction. The length of the surface 362*a* in the horizontal direction shown in FIG. 12 (i.e. the 'depthwise' length with respect to direction of arrow D3) is set at over 10 mm similarly to the first embodiment. The charge removal needle 350*a* and the plate type conductive member 360*a* are connected to a ground G4 through a wiring 364. A plate member 300 according to this embodiment does not have a wall part at the downstream side of the charge removal needle 350*a* (for example, the wall part 204 according to the first embodiment). The plate member 300 has only a wall part 302 at an upstream side of the charge removal needle 350*a*.

Also in this embodiment, electric potential of the belt 46 (and electric potential of the printing paper P) can be stabilized by the time when the belt 46 reaches a photoreceptor (for example, the photoreceptor 56*b*) at the downstream side of the belt 46. Further, since the charge removal needle 350*a* and the plate type conductive member 360*a* are configured integrally, the number of components which constitute the printer 2 is reduced. A process of assembling the charge removal needle 350*a* and a process of assembling the plate type conductive member 360*a* can be carried out simultaneously.

The embodiments described above can be modified in various ways. Examples of the modifications described above will be listed below.

(1) The techniques disclosed in the embodiments described above can be applied to an intermediate transfer belt which is used in an intermediate transfer method. Specifically, in the moving direction of the intermediate transfer belt onto which developer is transferred from a photoreceptor, a charge removal member may be located at an upstream side and a conductive member may be located at a downstream side.

(2) A shape of the charge removal member is not limited to a shape of needle which tapers off to a point. For example, a charge removal member whose diameter is unchangeable (e.g. in a shape that is narrower than the conductive member) may be used.

(3) The conductive member is not limited to a shape of film or a shape of plate. Various other shapes can be adopted.

What is claimed is:

1. An image forming apparatus, comprising:

a plurality of photoreceptors aligned in a predetermined direction;

a belt configured to move in the predetermined direction and face the plurality of photoreceptors, wherein the belt is ring-shaped and the plurality of photoreceptors is located at a front surface side of the belt;

a charge removal member located at a back surface side of the belt and between two photoreceptors adjacent to each other in the predetermined direction, wherein the charge removal member is configured to remove charge of the belt, and wherein the charge removal member includes a needle-shaped portion that tapers off to an end portion facing the belt;

a conductive member located at the front surface side of the belt and between the two photoreceptors adjacent to each other in the predetermined direction, wherein the conductive member is located at a downstream side of the charge removal member in the predetermined direction, and is provided with a surface facing the belt; and a wall member extending along the charge removal member, wherein the wall member is located at the back surface side of the belt and extends toward a back surface of the belt beyond the charge removal member, wherein the wall member and the conductive member face each other with the belt therebetween.

2. The image forming apparatus as in claim 1, further comprising:

another conductive member located between the two photoreceptors which are adjacent to each other in the predetermined direction, wherein the other conductive member is located at the downstream side of the charge removal member in the predetermined direction, and is provided with a surface facing the belt.

3. The image forming apparatus as in claim 2, wherein the other conductive member is located at the back surface side of the belt.

4. The image forming apparatus as in claim 1, further comprising:

an image forming apparatus main body; and a casing housing the plurality of photoreceptors, and configured to attach to the image forming apparatus main body in a detachable manner, wherein the conductive member is coupled to the casing.

5. The image forming apparatus as in claim 1, wherein the belt is configured to convey a medium on which an image is to be formed.

6. The image forming apparatus as in claim 1, wherein the belt comprises a portion facing the plurality of photoreceptors, and the portion moves in the predetermined direction.

7. The image forming apparatus as in claim 6, wherein no charge removal member is located at a downstream side of a rearmost photoreceptor in the predetermined direction, and no conductive member is located at the downstream side of the rearmost photoreceptor in the predetermined direction.

8. The image forming apparatus as in claim 1, wherein the belt is configured to rotates, and comprises a first portion and a second portion, the first portion faces the plurality of photoreceptors, and moves in the predetermined direction, and the second portion moves in an opposite direction of the predetermined direction.

9. The image forming apparatus as in claim 8, further comprising:

a cleaning member located at a position facing the second portion, wherein the cleaning member is configured to clean up the belt by utilizing an electric field;

another charge removal member located at a downstream side of the cleaning member in a rotational direction of the belt, wherein the other charge removal member is located at an upstream side of a foremost photoreceptor in the rotational direction of the belt, and the other charge removal member is configured to remove charge of the belt; and another conductive member located at the downstream side of the cleaning member in the rotational direction of the belt, wherein the other conductive member is located at the upstream side of the foremost photoreceptor in the rotational direction of the belt, and is provided with a surface facing the belt, wherein the other charge removal member is located at the upstream side of the other conductive member in the rotational direction of the belt.

10. An image forming apparatus, comprising:

a photoreceptor;

a belt configured to move in a predetermined direction and face the photoreceptor, wherein the belt is ring-shaped and the photoreceptor is located at a front surface side of the belt;

a cleaning member configured to clean up the belt by utilizing an electric field;

a charge removal member located at a back surface side of the belt and at a downstream side of the cleaning member in the predetermined direction, wherein the charge removal member is located at an upstream side of the photoreceptor in the predetermined direction, and the charge removal member is configured to remove charge of the belt, and wherein the charge removal member includes a needle-shaped portion that tapers off to an end portion facing the belt;

a conductive member located at the front surface side of the belt and at the downstream side of the charge removal member in the predetermined direction, wherein the conductive member is located at the upstream side of the photoreceptor in the predetermined direction, and is provided with a surface facing the belt; and a wall member extending in a direction perpendicular to the charge removal member, wherein the wall member is located at the back surface side of the belt and extends toward a back surface of the belt beyond the charge removal member, wherein the wall member and the conductive member face each other with the belt therebetween.

11. An image forming apparatus, comprising:

a plurality of photoreceptors aligned in a predetermined direction;

a belt configured to move in the predetermined direction and face the plurality of photoreceptors, wherein the belt is ring-shaped and the plurality of photoreceptors is located at a front surface side of the belt;

a charge removal member located at a back surface side of the belt and between two photoreceptors adjacent to each other in the predetermined direction, wherein the charge removal member is configured to remove charge of the belt, and wherein the charge removal member includes a needle-shaped portion that tapers off to an end portion facing the belt;

a conductive member located at the back surface side of the belt and between the two photoreceptors adjacent to each other in the predetermined direction, wherein the conductive member is located at a downstream side of the charge removal member in the predetermined direction, and is provided with a surface facing the belt; and a wall member extending along the charge removal member, wherein the wall member is located at the back surface side of the belt and extends toward a back surface of the belt beyond the charge removal member.

* * * * *

UNITED STATES PATENT AND TRADEMARK OFFICE

CERTIFICATE OF CORRECTION

PATENT NO. : 8,005,401 B2
APPLICATION NO. : 12/342528
DATED : August 23, 2011
INVENTOR(S) : Furukawa et al.

It is certified that error appears in the above-identified patent and that said Letters Patent is hereby corrected as shown below:

In Column 13, Claim 8, Line 44:
Please delete “rotates” and insert --rotate--

Signed and Sealed this
Third Day of April, 2012

David J. Kappos

David J. Kappos
*Director of the United States Patent and Trademark Office*